US006492896B2

(12) United States Patent
Yoneda

(10) Patent No.: US 6,492,896 B2
(45) Date of Patent: Dec. 10, 2002

(54) CHIP RESISTOR

(75) Inventor: Masaki Yoneda, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 0 days.

(21) Appl. No.: 09/900,151

(22) Filed: Jul. 9, 2001

(65) Prior Publication Data

US 2002/0003466 A1 Jan. 10, 2002

(30) Foreign Application Priority Data

Jul. 10, 2000 (JP) ..... 2000-208815

(51) Int. Cl.[7] ..... H01C 1/012

(52) U.S. Cl. ..... 338/309; 338/195; 338/307; 338/313; 338/332

(58) Field of Search ..... 338/309, 307, 338/313, 314, 327, 332, 195

(56) References Cited

U.S. PATENT DOCUMENTS 4,792,781 A * 12/1988 Takahashi et al. ..... 338/307
4,829,553 A * 5/1989 Shindo et al. ..... 338/309
5,379,017 A * 1/1995 Katsuno ..... 338/309
5,917,403 A * 6/1999 Hashimoto et al. ..... 338/307
5,990,781 A * 11/1999 Kambara ..... 338/309
6,023,217 A * 2/2000 Yamada et al. ..... 338/309
6,242,999 B1 * 6/2001 Nakayama et al. ..... 338/309
6,304,167 B1 * 10/2001 Nakayama ..... 338/195

* cited by examiner

*Primary Examiner*—Karl D. Easthom
(74) *Attorney, Agent, or Firm*—Morgan, Lewis & Bockius LLP

(57) ABSTRACT

There are provided a pair of upper surface electrodes 21, 31 at both end sections, which are opposed to each other, of the insulating substrate 1 made of alumina. There is provided a resistor body 4 on the substrate 1 so that the upper surface electrode 21 and both the end sections can be electrically connected with each other. On the pair of upper surface electrodes 21, 31, there are provided a pair of upper surface auxiliary electrodes 24, 34 made of material, the heat-resistance with respect to solder of which is superior to that of the upper surface electrodes 21, 31, so that the exposed sections of the upper surface electrodes 21, 31 can be completely covered with the pair of upper surface auxiliary electrodes 24, 34, wherein the pair of upper surface auxiliary electrodes 24, 34 are not directly connected with the resistor body 4. On the surface of the resistor body 4, there is provided a protective film 5 (a first protective film 51 to a third protective film 53).

2 Claims, 3 Drawing Sheets

CHIP RESISTOR

BACKGROUND OF THE INVENTION

1. Field of the Invention

The present invention relates to a chip resistor in which a resistor body film is provided on a chip type insulating substrate. More particularly, the present invention relates to a highly reliable chip resistor in which an electrode coming into contact with a resistor body is made of material, which is seldom diffused into the resistor body, the heat-resistance with respect to solder of which is high, so that the electrode can be seldom eroded by solder and the reliability can be enhanced.

2. Description of the Related Art

As related arts of this invention, two types of chip resistors have been known such taht one is a thick film resistor of which electrode and resistor are manufactured by means of printing or baking, and the other is a thin film resistor which electrode and resistor are manufactured by means of spattering method. Although the thickness of the film is different from each other between the thick film resistor and the thin film resistor, the structure of the thick film resistor and that of the thin film resistor are almost the same. For example, the structure is shown in FIG. 5. In FIG. 5, at both end sections of the insulating substrate 1 made of alumina which are opposed to each other, there are provided a pair of electrodes 2, 3 which include upper surface electrodes 21, 31, reverse face electrodes 22, 32 and side electrodes 23, 33 connecting these electrodes. Further, there is provided a resistor body 4 on the insulating substrate 1 in such a manner that the resistor body 4 is connected with both the electrodes. On the surface side of the resistor body, there are provided one to three layers of protective films 5 (51 to 53). In order to easily mount the pair of electrodes 2, 3 on a circuit substrate, Ni-plating layers 25*a*, 35*a* and solder-plating layers 25*b*, 35*b* are provided on the surfaces of the pair of electrodes 2, 3.

The thick film resistor is made in such a manner that paste-like material made of glass or resin is coated by means of printing and baked at 600 to 900° C. in the case of glass or cured at 200 to 300° C. in the case of resin. Concerning the electrode material, Ag paste (silver paste) is used in which Pd is added to Ag. Concerning the resistor body material, paste is used in which Ag or Pd is mixed with glass, resin or ruthenium oxide so as to obtain a necessary resistance value. Concerning this thick film resistor, the equipment cost of the manufacturing apparatus is low, and further the thick film resistor can be manufactured in a short period of time in the manufacturing process. Therefore, the manufacturing cost of the thick film resistor is much lower than that of the thin film resistor which must be manufactured by means of spattering. Accordingly, the thick film resistor is conveniently used.

As described above, the thick film resistor can be easily manufactured in the manufacturing process, however, materials of the electrode and resistor body are made of paste in which glass paste or resin paste is mixed, and this mixed paste is coated, and baked or cured. Therefore, for example, when electrode material made of silver paste comes into contact with the resistor body, Ag in the electrode diffuses into the resistor body, so that the characteristic of the resistor body such as a resistance value and a temperature coefficient fluctuates. In order to solve the above problems, it is considered that the upper surface material is not made of Ag paste but Au paste.

On the other hand, even in the case of a chip resistor in which Au paste is used as the electrode material, the following problems are caused. When soldering is conducted on the chip resistor in the process of mounting, the resistance value is suddenly increased or the resistor is put into an open state.

SUMMARY OF THE INVENTION

The present invention has been accomplished in view of the above circumstances. It is an object of the present invention to provide a chip resistor having the electrode material being not diffused into the resistor body in the manufacturing processso that the characteristic of the resistor body is not changed, and further, there is no possibility of the chip resistor being not put into an open state in the case of mounting.

The inventors of this present invention have found it out through their hard investigations that the chip resistors, such as showing sudden increase of the resistance value or showing an open state after the completion of soldering in the process of mounting, have their own specific reason. That is to say, said reason is such that upper surface electrode made of material of gold, which is used as material for preventing metal diffusion into the resistor body, is melted into solder on the lower side of an interface between the solder plating layer and the protective film (shown by "A" indicated in FIG. 5) by which the upper surface electrode disconnected. In order to prevent the electrode material from being melting into solder, this invention arrives at a conclusion that it is effective to cover the upper surface electrode with electrode material of Ag rather than that of Au from the fact that the melting-resistance of Ag with respect to solder at high temperature is stronger than that of Au.

The present invention provides a chip resistor comprising: an insulating substrate; a pair of upper surface electrodes provided at both end sections of the substrate opposed to each other; a resistor body arranged on the substrate so that both end sections of the resistor body can be electrically connected with the pair of upper surface electrodes; a pair of upper surface auxiliary electrodes made of material, the heat-resistance with respect to solder of which is higher than that of the upper surface electrodes, which are respectively arranged on the pair of upper surface electrodes so that the exposed sections of the upper surface electrodes can be completely covered with the pair of upper surface auxiliary electrodes, the pair of upper surface auxiliary electrodes not directly coming into contact with the resistor body; and a protective film provided on the surface of the resistor body. In this case, the melting-resistance of material with respect to solder at high temperature is defined as a property in which the material is not melted into solder even when the material comes into contact with solder and the temperature of the material is raised.

In the above structure, the upper surface electrode is made of material of Au which is seldom diffused into the resistor body, and the upper surface auxiliary electrode, the heat-resistance with respect to solder of which is high, is provided on the surface of the upper surface electrode. Due to the above structure, there is no possibility that melted solder reaches the upper surface electrode in the process of soldering. Therefore, the upper surface electrode is not melted into solder. On the other hand, since the upper auxiliary electrode is not contacted with the resistor body, when it is baked or cured in the manufacturing process, the material of the upper surface auxiliary electrode is not diffused into the resistor body.

The protective film includes: a first protective film covering a surface of the resistor body in the case of laser beam trimming; a second protective film covering the inside of a recessed groove formed by laser beam trimming after the completion of laser beam trimming, the second protective film completely covering the exposed section of the resistor body; and a third protective film, which is provided on the second protective film, for making the surface flat, wherein the upper surface auxiliary electrodes are arranged overlapping the second protective film and the upper surface electrodes so that the upper surface auxiliary electrodes can not directly come into contact with the resistor body.

Specifically, when the upper surface electrode is made of material of gold and the upper surface auxiliary electrode is made of material of silver, no electrode material diffuses into the resistor body, and it becomes possible to prevent the electrode material from melting into solder in the process of soldering. In this case, the material of gold is defined as material, the primary component of which is Au, capable of containing other elements, and the material of silver is defined as material, the primary component of which is Ag, capable of containing other elements.

DESCRIPTION OF THE PREFERRED EMBODIMENTS

Figure 1:
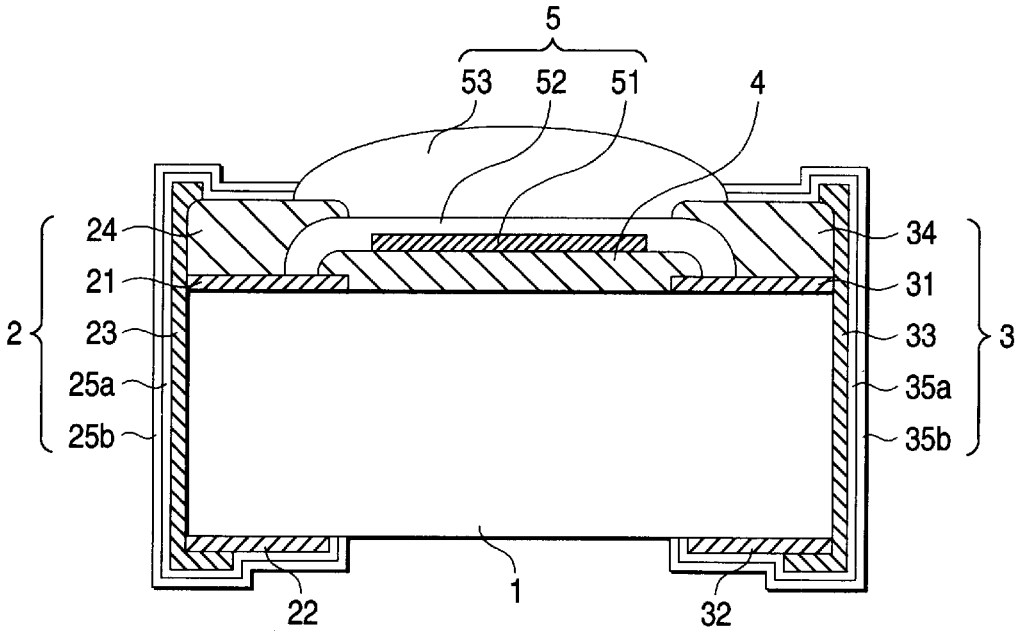
FIG. 1 shows a cross-sectional schematic illustration showing an embodiment of the chip resistor of the present invention.

With referring to the drawings, the chip resistor of the present invention will be explained below. As an embodiment of the chip resistor of the present invention is shown in FIG. 1 which is a cross-sectional schematic illustration, at both end sections of the rectangular insulating substrate 1, for example made of alumina, which are opposed to each other, there are provided a pair of upper surface electrodes 21, 31. On the insulating substrate 1, there is provided a resistor body 4 so that the pair of upper surface electrodes 21, 31 can be electrically connected with both the end sections of the insulating substrate 1. On the pair of upper surface electrodes 21, 31, there are provided a pair of upper surface auxiliary electrodes 24, 34 made of material, the heat-resistance with respect to solder of which is superior to that of the upper surface electrodes 21, 31, so that the exposed sections of the upper surface electrodes 21, 31 can be completely covered with the pair of upper surface auxiliary electrodes 24, 34, wherein the pair of upper surface auxiliary electrodes 24, 34 are not directly connected with the resistor body 4. On the surface of the resistor body 4, there is provided a protective film 5 (a first protective film 51 to a third protective film 53).

Figure 4:
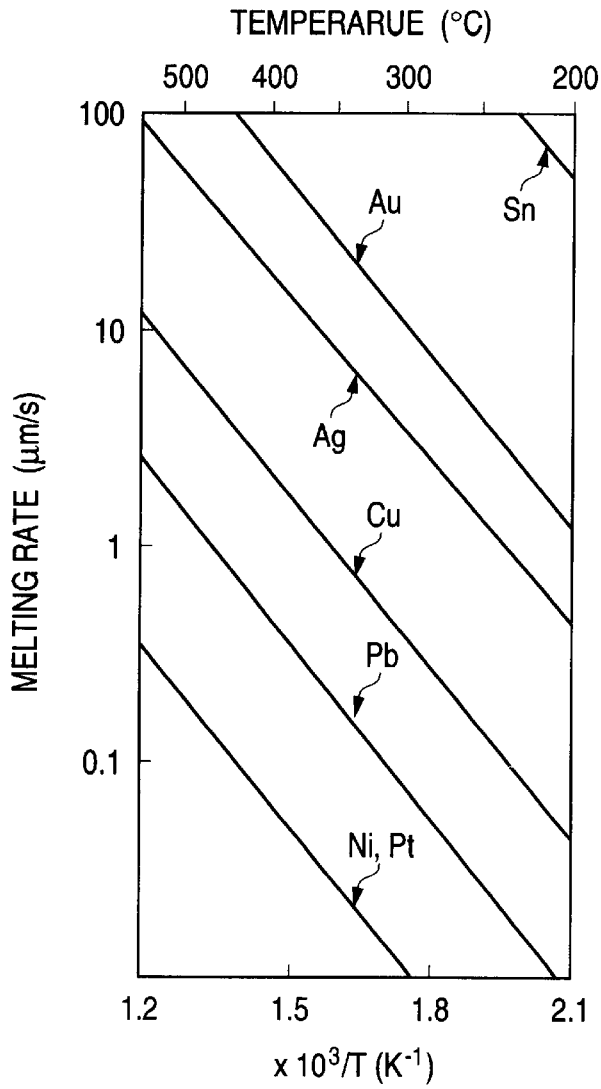
FIG. 4 shows a graph showing melting rates of various metals into solder, wherein the melting rates of various metals are compared with each other.

As described above, the present inventors have made investigation in good earnest into the cause of a phenomenon in which the resistance value of the chip resistor is suddenly increased or the chip resistor is suddenly put into an open state in the case of mounting the chip resistor on a circuit substrate and others. As a result of the investigation, the present inventors have found the following. In the case of soldering when the chip resistor is mounted, the melted solder reaches the upper surface electrode via an interface between the protective film and the plating layer, so that Au in the upper surface electrode is melted. As shown in FIG. 4, the melting rate ($\mu$m/s) of Au into the melted solder (60Sn—40Pb solder) is 30 ($\mu$m/s) at 350° C. On the other hand, the melting rate ($\mu$m/s) of Ag into the melted solder is 8 ($\mu$m/s) which is not more than ⅓ of the melting rate 30 ($\mu$m/s) of Au. Therefore, in the process of soldering, Au is easily melted in solder. That is, when the material of Au is used for the electrode, the electric conductivity is lost. The present inventors have found the above fact.

On the other hand, when the material of Ag is used for the electrode, the following problems are caused. In the process of manufacturing a chip resistor, Ag tends to diffuse into the resistor body, and the characteristic of the resistor body is changed. Due to the foregoing, the present inventors have found the following. The material of Au is used for the electrode coming into contact with the resistor body, and the upper surface auxiliary electrode, which is made of material difficult to melt into solder, is provided in such a manner that the upper surface auxiliary electrode covers the upper surface side which tends to come into contact with solder. Due to the above structure, it is possible to solve the problems in which the characteristic such as a resistance value of the resistor is changed and the electrode material is melted. As shown in FIG. 4, from the viewpoint of solubility with respect to solder, the melting rate of Cu is 1 ($\mu$m/s), which is preferable. However, Cu is easily oxidized. Therefore, Cu was not used in the investigation this time. From the above viewpoint, it is also preferable to use Ni or Pt.

Figure 2:
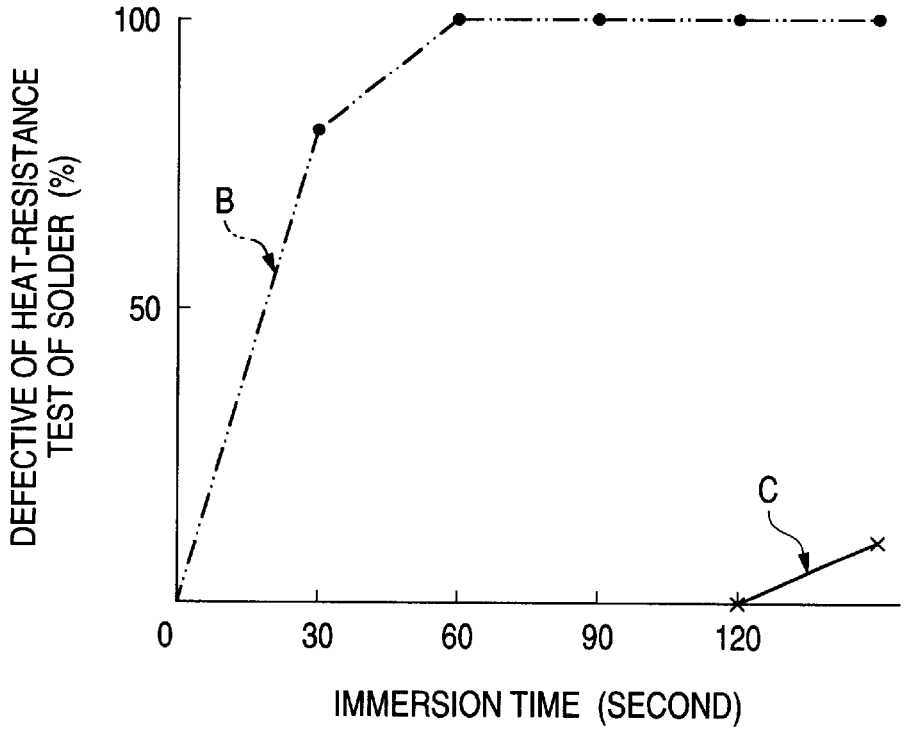
FIG. 2 shows a graph showing a comparison between the percent of defective in the case of the structure of the present invention and the percent of defective in the case of the structure of the prior art when the chip resistors are immerseped in solder.
Figure 5:
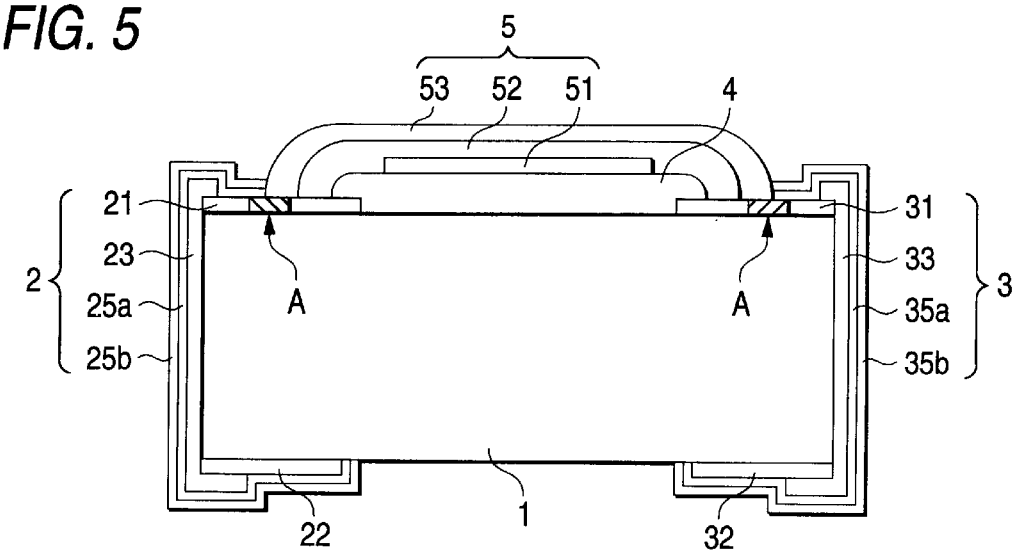
FIG. 5 shows a cross-sectional schematic illustration for explaining a structure of the chip resistor of the prior art.

FIG. 2 is a graph showing a result of the investigation in which a change in the percent defective was investigated with respect to the immerseimmersion time when the electrode material was immerseped in solder (60Sn—40Pb), the temperature of which was 350° C. In the graph, curve B represents a case in which the structure is composed as shown in FIG. 5, the upper electrode is made of the material of Au and the third protective film is made of resin. In the graph, curve C represents a case in which the structure is composed as shown in the present invention, an upper surface auxiliary electrode made of the material of Ag is provided so that the upper surface auxiliary electrode can cover the upper surface electrode made of the material of Au and the third protective film is made of resin. When the present inventors analyzed the cross-section of a defective, it was confirmed that the upper surface electrode below an interface between the protective film and the plating layer of the electrode melted and disappeared in solder, so that the chip resistor was put into an open state.

As is shown by curve B in FIG. 2, in the case of an electrode made of the material of Au, the chip resistor became defective in about 60 seconds. On the other hand, in the case of a structure in which the upper surface auxiliary electrode made of the material of Ag shown by C was provided, no defective was caused even when 120 seconds passed away. In this connection, this percentage defective was obtained when 30 samples were tested.

The substrate 1 is made of, for example, alumina, sapphire or Si wafer. 5 Concerning the electrode material of thick film, paste is used in which metal powder and glass, or metal powder and resin are mixed. In this case, metal powder of Ag, Ag—Pd or Au is used. In the example shown in FIG. 1, a thick film electrode made of Au glass paste, which is seldom diffused into the resistor body 4, is used for the upper surface electrodes 21, 31. In this connection, the glass paste is cured when it is baked at 600 to 900° C.

On the upper surface electrodes 21, 31, there are provided upper surface auxiliary electrodes 24, 34 made of resin paste of Ag. These upper surface auxiliary electrodes 24, 34 are provided in such a manner that they are not directly contacted with the resistor body 4 being separated by the second protective film 52 which will be described later in the description of the protective film 5. Therefore, the upper surface auxiliary electrodes 24, 34 are not diffused into the resistor body 4. Accordingly, it is possible to select the material of the upper surface auxiliary electrodes 24, 34 when consideration is given only to the heat-resistance with respect to solder. On the sides of the insulating substrate 1, there are provided side electrodes 23, 33, which are composed of thick film electrodes made of resin paste of Ag, so that the upper surface auxiliary electrodes 24, 34 and the reverse face electrodes 22, 32 can be connected with each other by the side electrodes 23, 33. The reverse face electrodes 22, 32 are composed of a thick film made of glass paste of Ag. When Ni-plating layers 25*a*, 35*a* and solder-plating layers 25*b*, 35*b* are respectively provided on the surfaces of the electrodes, the pair of electrodes 2, 3 are formed. In this connection, resin paste is cured when it is heated to 200 to 300° C.

The resistor body 4 is composed of a thick film which is formed in such a manner that paste made by mixing ruthenium oxide ($RuO_2$) and Ag powder in glass paste is coated by means of printing and then baked at 800 to 900° C. Concerning this resistor body 4, in the case of a thick film resistor body, Ag contained in the electrode material can be easily diffused. Therefore, it is possible to provide a great effect of the present invention. However, even in the case of a thin film resistor body which is made in such a manner that a metal film of Ni—Cr, Ta, Ta—N or Ta—Si is formed by means of spattering and patterned into a predetermined profile in the process of photolithography, it is possible to use the upper surface auxiliary electrode of the present invention, the solder-resistance of which is superior.

In the example shown in FIG. 1, the protective film 4 includes: a first protective film 51 which is provided for preventing the shavings of the resistor body 4, which have been produced when the resistor body 4 was shaven by means of laser beam trimming in order to adjust a value of resistance of the resistor body 4, from adhering; a second protective film 52 provided for filling the grooves formed by laser beam trimming; and a third protective film 53 provided for protecting and flattening the entire surface. The first protective film 51 is formed in such a manner that glass power of boro-silicated lead glass is made paste-like and coated by means of printing and baked at 600 to 800° C. The second protective film 52 and the third protective film 53 are formed in such a manner that paste made of epoxy resin is coated by means of printing and cured at 200 to 300° C. so that the value of resistance can not be changed in the baking process conducted at high temperatures.

Figure 3:
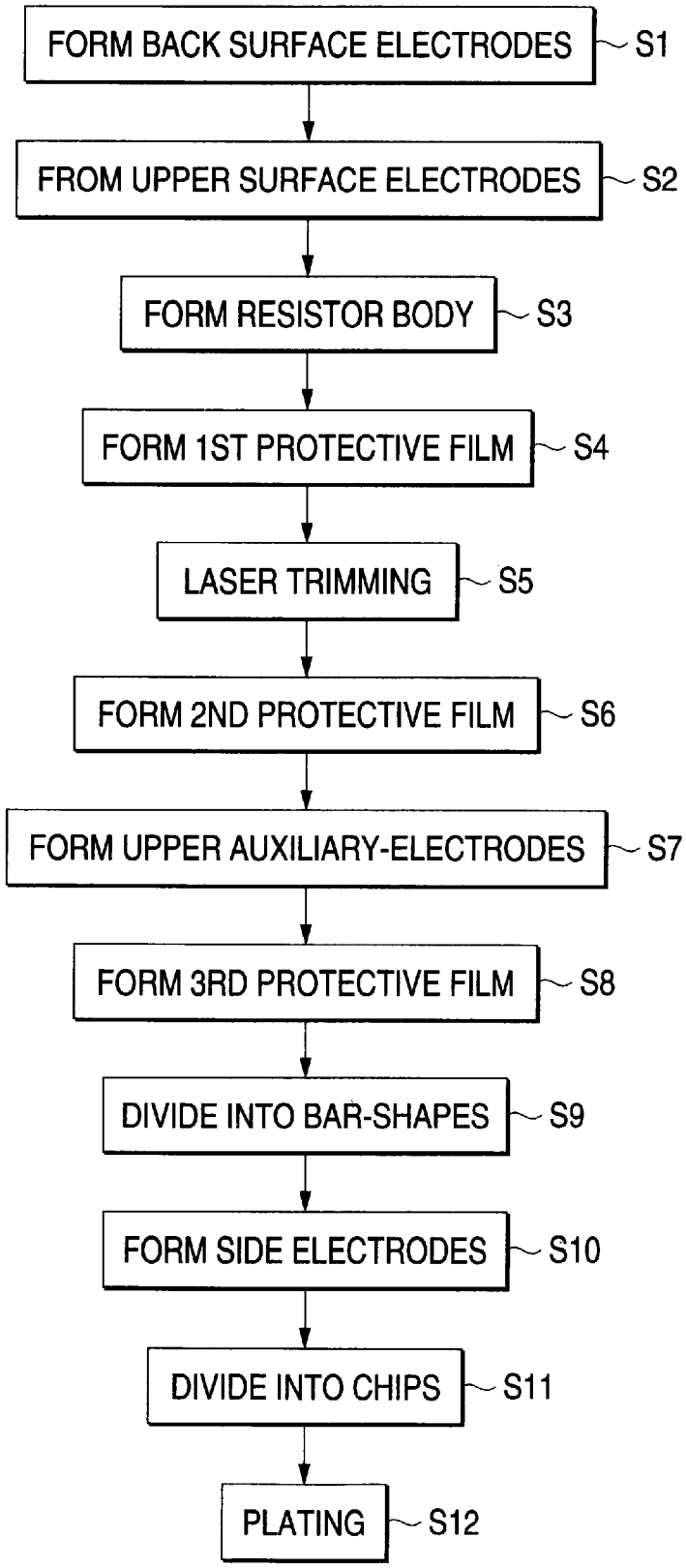
FIG. 3 shows a flow chart showing an example of manufacturing the chip resistor show in FIG. 1.

When the protective film 5 of the three-layer structure is formed as described above, after the second protective film completely covering the resistor body 4 has been formed, the upper surface auxiliary electrodes 24, 34 are formed. Therefore, the upper surface auxiliary electrodes 24, 34 can be completely separated from the resistance body 4. Accordingly, it is possible to select the material of the upper surface auxiliary electrodes 24, 34 when consideration is given only to solder-resistance without giving consideration to the diffusion of the electrode metal into the resistor body 4. That is, the material of Au, which is not diffused into the resistor body 4, is used for the upper electrodes 21, 31 coming into direct contact with the resistor body 4, and the material of Ag, the solder-resistance of which is high, is used for the upper surface auxiliary electrodes 24, 34 not coming into contact with the resistor body 4. As described before, when the second protective film 52 and the third protective film 53 are baked at high temperatures, the characteristic of the resistor body 4 such as a value of resistance may be changed. Therefore, it is preferable that the second protective film 52 and the third protective film 53 are formed by coating resin paste made of epoxy resin and curing it at 200 to 300° C. Next, referring to the flow chart shown in FIG. 3, the method of manufacturing this chip resistor will be explained below. In this connection, FIG. 1 is a cross-sectional schematic illustration showing one piece of chip resistor. However, the chip resistor is actually manufactured as follows. Electrodes and resistor bodies, the number of which is approximately 100 to 10000, are simultaneously formed on a substrate, the size of which is 5 to 10 cm×5 to 10 cm. Then, the thus formed electrodes and resistor bodies are cut into bars, and the side electrodes are formed on the exposed sides, and further the chip resistors, which are connected with each other being formed into bars, are cut and separated into a chip-shape.

First, paste of the electrode material made of glaze paste of Ag is printed at a predetermined position on the reverse face of the substrate 1. When this paste of the electrode material is baked at 600 to 900° C., the reverse face electrodes 22, 32 (shown in FIG. 1) composed of a thick film can be formed (S1). Next, the electrode material made of metallic organic substance of Au or glass paste is coated by means of printing in a portion on the surface of the substrate 1 corresponding to the reverse face electrodes 22, 32 and baked. In this way, the pair of upper surface electrodes 21, 31 are formed (S2). After that, the resistor material made of glass paste of $RuO_2$ is coated by means of printing so that both end sections can overlap a portion of the pair of upper surface electrodes 21, 31. The thus coated resistor material is baked at 700 to 900° C. so as to form the resistor body 4 (S3).

After that, glass paste of boro-silicated lead glass is coated by means of printing on the surface of the resistor body 4 and baked at 600 to 800° C. In this way, the first protective film 51 is formed (S4). While the value of resistance is being measured by contacting a globe electrode with the pair of upper surface electrodes 21, 31, laser beam trimming is conducted so as to obtain a predetermined value of resistance. In this way, the value of resistance is adjusted (S5). Further, resin paste is coated on the surface and cured. In this way, the second protective film 52 is formed (S6). Next, the upper surface auxiliary electrodes 24, 34 are formed in such a manner that the electrode material made of resin paste of Ag, in which Ag is mixed with resin, is coated by means of printing on the exposed sections of the upper surface electrodes 21, 31 and also coated so that it can overlap a portion of the second protective film 52, and the thus coated electrode material is cured at 200 to 300° C. In this way, the upper surface auxiliary electrodes 24, 34 are formed (S7). When the same paste is coated and cured on the second protective film 52, the third protective film 53 is formed (S8).

Next, the large substrate is divided into a bar-shape so that it can be separated into rows perpendicular to the direction connecting the pair of upper surface electrodes 21, 31 (S9).

Next, between the upper surface auxiliary electrodes 24, 34 and the reverse face electrodes 22, 32, the electrode material made of resin paste of Ag is coated and cured so that it can overlap the upper surface auxiliary electrodes 24, 34 and the reverse face electrodes 22, 32. In this way, the side electrodes 23, 33 are formed (S10). After that, the chip resistors connected with each other in a bar-shape are separated from each other into a chip-shape (S11). Then, the exposed face of the electrode is subjected to Ni-plating and solder-plating of Pb/Sn, so that the plating layers 25*a,* 35*a,* 25*b,* 35*b* are formed (S12). In this way, the chip resistor shown in FIG. 1 can be provided.

According to the present invention, in the electrode portion coming into contact with the resistor body, the upper surface electrode is formed from material of Au which is less diffused into the resistor body. Accordingly, there is no possibility that the electrode material is diffused into the resistor body in the baking process and that the characteristic such as a value of resistance is changed. On the surface of the upper surface electrode which tends to come into contact with solder, the upper surface auxiliary electrode is formed from material such as material of Ag, the solder-resistance of which is high. Therefore, even in the process of soldering, there is no possibility that the electrode material is melted into solder. Accordingly, the value of resistance is not increased and the chip resistor is not put into an open state.

According to the present invention, the characteristic of the resistor body is not changed in the manufacturing process, and the electrode is not melted into solder. Therefore, it is possible to provide a chip resistor, the resistance characteristic of which is very stable and the reliability of which is high.

What is claimed is:

1. A chip resistor comprising:

an insulating substrate;

a pair of upper surface electrodes provided on the insulating substrate opposite to each other;

a resistor body arranged on the insulating substrate so that both end-parts of the resistor body are electrically connected to the pair of upper surface electrodes respectively;

a pair of upper surface auxiliary-electrodes respectively formed on the pair of upper surface electrodes so as to completely cover exposed sections of the upper surface electrodes while being spaced from the resistor body, said pair of upper surface auxiliary-electrodes made of material having heat-resistance higher than that of the upper surface electrodes with respect to solder; and a protective film provided on the surface of the resistor body, wherein the protective film is further comprised of:

a first protective film covering a surface of the resistor body in a case of laser beam trimming;

a second protective film covering inside of a recessed groove formed by said laser beam trimming and exposed part of the resistor body, and a third protective film formed on the second protective film, wherein said pair of upper surface auxiliary-electrodes are overlapped with said second protective film.

2. A chip resistor according to claim 1, wherein said upper surface electrodes are made of gold or a mixture thereof and the upper surface auxiliary-electrodes are made of silver or a mixture thereof.

* * * * *